US005482532A

United States Patent [19]

Isshiki et al.

[11] Patent Number: 5,482,532

[45] Date of Patent: Jan. 9, 1996

[54] METHOD OF AND APPARATUS FOR PRODUCING METAL POWDER

[75] Inventors: Naotsugu Isshiki, Tokyo; Hiroshi Izaki, Osaka; Yosimitu Tokunaga, Osaka; Syoichi Yoshino, Osaka; Masanori Yoshino, Osaka; Toshiyuki Aoki, Osaka, all of Japan

[73] Assignee: Kubota Corporation, Osaka, Japan

[21] Appl. No.: 238,353

[22] Filed: May 5, 1994

Related U.S. Application Data

[63] Continuation of Ser. No. 969,847, Feb. 3, 1993, abandoned.

[30] Foreign Application Priority Data

Jun. 5, 1991 [JP] Japan ..... 3-134349
Sep. 17, 1991 [JP] Japan ..... 3-236414

[51] Int. Cl.[6] ..... B22F 9/10; C22B 9/05

[52] U.S. Cl. ..... 75/333; 75/337; 75/338; 264/12; 266/202; 425/7

[58] Field of Search ..... 75/333, 337, 338; 266/200, 202; 425/6, 7; 264/11, 12

[56] References Cited

U.S. PATENT DOCUMENTS 4,405,535 9/1983 Raman et al. ..... 264/11
4,787,935 11/1988 Eylon et al. ..... 425/7
4,810,284 3/1989 Auran et al. ..... 75/338
4,824,478 4/1989 Roberts et al. ..... 425/7
4,905,899 3/1990 Coombs et al. ..... 264/12
5,352,267 10/1994 Yoshino et al. ..... 75/338

FOREIGN PATENT DOCUMENTS 61-44111 3/1986 Japan .
1-198410 8/1989 Japan .
1-49769 10/1989 Japan .

*Primary Examiner*—George Wyszomierski
*Attorney, Agent, or Firm*—Armstrong, Westerman, Hattori, McLeland & Naughton

[57] ABSTRACT

The invention provides a method of producing metal powders which is less likely permit variations in cooling rate, ensures rapid solidification at a great cooling rate and readily gives fine particles, and a production apparatus for the method. The method comprises injecting a cooling liquid into a cooling tubular body (1) along an inner peripheral surface thereof to form a cooling liquid layer (9) moving toward a cooling liquid discharge end of the tubular body (1) while swirling along the inner peripheral surface of the tubular body (1); supplying a molten metal (25) to a space (23) inside the cooling liquid layer (9); applying a gas jet (26) as directed toward the cooling liquid layer (9) to the molten metal (25) to divide the molten metal and supply the divided molten metal to the cooling liquid layer (9); and discharging the cooling liquid containing a metal powder solidified in the liquid layer (9) from the cooling liquid discharge end of the tubular body (1) to outside.

16 Claims, 9 Drawing Sheets

METHOD OF AND APPARATUS FOR PRODUCING METAL POWDER

This application is a Rule 62 continuation of application Ser. No. 07/969,847 filed Feb. 3, 1993, now abandoned.

TECHNICAL FIELD

The present invention relates to a method of and an apparatus for producing metal powders by supplying a molten metal to a cooling liquid layer in a swirling movement.

BACKGROUND ART

Rapidly solidified metal powders are in the form of fine crystal grains and can be adapted to contain alloy elements to supersaturation, so that the extrudates and sintered materials prepared from rapidly solidified powders are superior to materials prepared by melting in characteristics and have attracted attention as materials for making machine parts.

The methods of producing rapidly solidified metal powders include the rotary drum method as disclosed in Examined Japanese Patent Publication HEI 1-49769. With this method, a rapidly solidified metal powder is prepared by rotating a cooling drum having a bottom and containing a cooling liquid to centrifugally form a cooling liquid layer over the inner periphery of the drum, and injecting a molten metal into the cooling liquid layer to divide the metal by the cooling liquid layer in a swirling motion.

On the other hand, U.S. Pat. No. 4,787,935 and U.S. Pat. No. 4,869,469 disclose methods and systems for producing a metal powder by atomizing a molten metal stream into spherical molten droplets and supplying the droplets to a swirling downward flow of cooling gas within a cooling cylinder for cooling and solidification.

The rotary drum method is adapted for a so-called batchwise operation and therefore has the problem of being low in productivity. Furthermore, the speed of rotation of the cooling drum, which is limited, poses the probelm in that it is difficult to give an increased flow velocity to the cooling liquid layer and to obtain a fine powder.

On the other hand, the production methods of the U.S. patents are adapted to continuously prepare a fine powder of 0.1 micrometer in size to a coarse powder of about 1000 micrometers. With these production methods, however, the cooling rate is limited to about $10^2$–$10^7$°C./sec and fails to achieve a sufficient rapid cooling effect. Further because the molten droplets encounter difficulity in undergoing a swirling motion in the central portion of the swirling cooling gas flow and are cooled at a reduced rate, there arises the problem that the quality of the powder produced is liable to involve variations. Additionally, the cooling cylinder needs to have a considerably large size to form therein a swirling cooling gas flow which is suitable for cooling the molten droplets. This poses another problem in that the methods are difficult to practice readily in view of the installation space and equipment cost.

An object of the present invention, which has been accomplished in view of the above problems, is to provide a method of producing metal powders which is less likely permit variations in cooling rate, ensures rapid solidification at a great cooling rate and readily gives fine particles, and a production apparatus which is suitable for practicing this method.

DISCLOSURE OF THE INVENTION

The present invention provides a method of producing a metal powder by injecting a cooling liquid into a cooling tubular body along an inner peripheral surface thereof to form a cooling liquid layer moving toward a cooling liquid discharge end of the tubular body while swirling along the tubular body inner peripheral surface; supplying a molten metal to a space inside the cooling liquid layer; applying a gas jet as directed toward the cooling liquid layer to the molten metal to divide the molten metal and supply the divided molten metal to the cooling liquid layer; and discharging the cooling liquid containing a metal powder solidified in the liquid layer from the cooling liquid discharge end of the tubular body to outside. The cooling liquid containing the metal powder is discharged to outside preferably through a discharge pipe attached to a closure provided at the discharge end of the tubular body while filling the pipe with the cooling liquid.

The present invention further provides a production apparatus comprising a cooling tubular body having a cooling liquid injection channel for injecting a cooling liquid into the tubular body along an inner peripheral surface thereof; molten metal supply means for supplying a molten metal into a space inside a cooling liquid layer formed by the cooling liquid injected from the injection channel and moving toward a cooling liquid discharge end of the tubular body while swirling along the tubular body inner peripheral surface; gas jet injection means for producing a gas jet to divide the molten metal and supply the divided molten metal to the cooling liquid layer; and cooling liquid supply means for supplying the cooling liquid to the cooling liquid injection channel. Preferably, the tubular body has a closure attached to its cooling liquid discharge end, and a discharge pipe attached to the closure for discharging the cooling liquid therethrough with the pipe filled with the cooling liquid.

According to the present invention, the cooling liquid injected from the injection channel into the tubular body along the inner peripheral surface thereof moves toward an opening at the discharge end of the body while swirling along the inner peripheral surface, whereby a cooling liquid layer of approximately uniform inside diameter is formed on the inner peripheral surface of the tubular body by virtue of the centrifugal force of the swirling motion. This layer is formed by the cooling liquid which is newly supplied at all times, and therefore readily maintained at a constant temperature. Since the cooling medium is a liquid, the medium is superior to gases in cooling ability. For these reasons, the cooling liquid layer can be small in the radius of swirling motion and in thickness, with the result that the cooling tubular body for forming the layer therein can be compact.

The gas jet injected from the injection means and directed toward the cooling liquid layer is forced against the molten metal supplied from the molten metal supply means into the space inside the cooling liquid to divide the molten metal. The divided molten metal (molten droplets) is sputtered toward the cooling liquid layer, and all the droplets are reliably supplied to and injected into the liquid layer. The molten droplets injected into the cooling liquid layer produce a vapor of the cooling liquid therearound, whereas the vapor is rapidly released from around the droplets. The reason is that since the liquid layer has a flow velocity which increases toward the center of the swirling motion, i.e., a gradient distribution of flow velocities, the molten droplets injected into the layer are in rotating motion. Consequently, the molten droplets have their outer peripheral surfaces always held in contact with the cooling liquid, are therefore cooled at a high rate and make particles which are free of surface contamination with the vapor. Further because the size of molten droplets to be formed by dividing is adjustable easily by controlling the flow velocity of the gas jet and the flow rate thereof, the desired rapidly solidified fine powder can be prepared with ease. Moreover, the cooling liquid layer remains unchanged and stabilized in temperature and surface condition, permitting the molten droplets to cool under a definite condition to give a powder of stabilized quality.

Since the cooling liquid layer is continuously formed, the powder can be produced also continuously by continuously supplying the molten metal and continuously applying the gas jet to the molten metal to divide the metal and supply the divided metal to the liquid layer. The metal powder solidified within the cooling liquid layer is continuously discharged from the liquid discharge end opening of the tubular body along with the cooling liquid.

It is desired to provide a closure for the liquid discharge end opening of the tubular body and to attach a discharge pipe to the closure so that the cooling liquid containing the metal powder can be discharged to outside through the pipe with the pipe filled with the cooling liquid. When the liquid is discharged in this way, the space inside the cooling liquid layer can be filled with the jet-forming gas easily. The molten droplets can be prevented from oxidation by using a suitable nonoxidizing gas, such as inert gas or reducing gas, as this gas.

BEST MODE OF CARRYING OUT THE INVENTION

Figure 1:
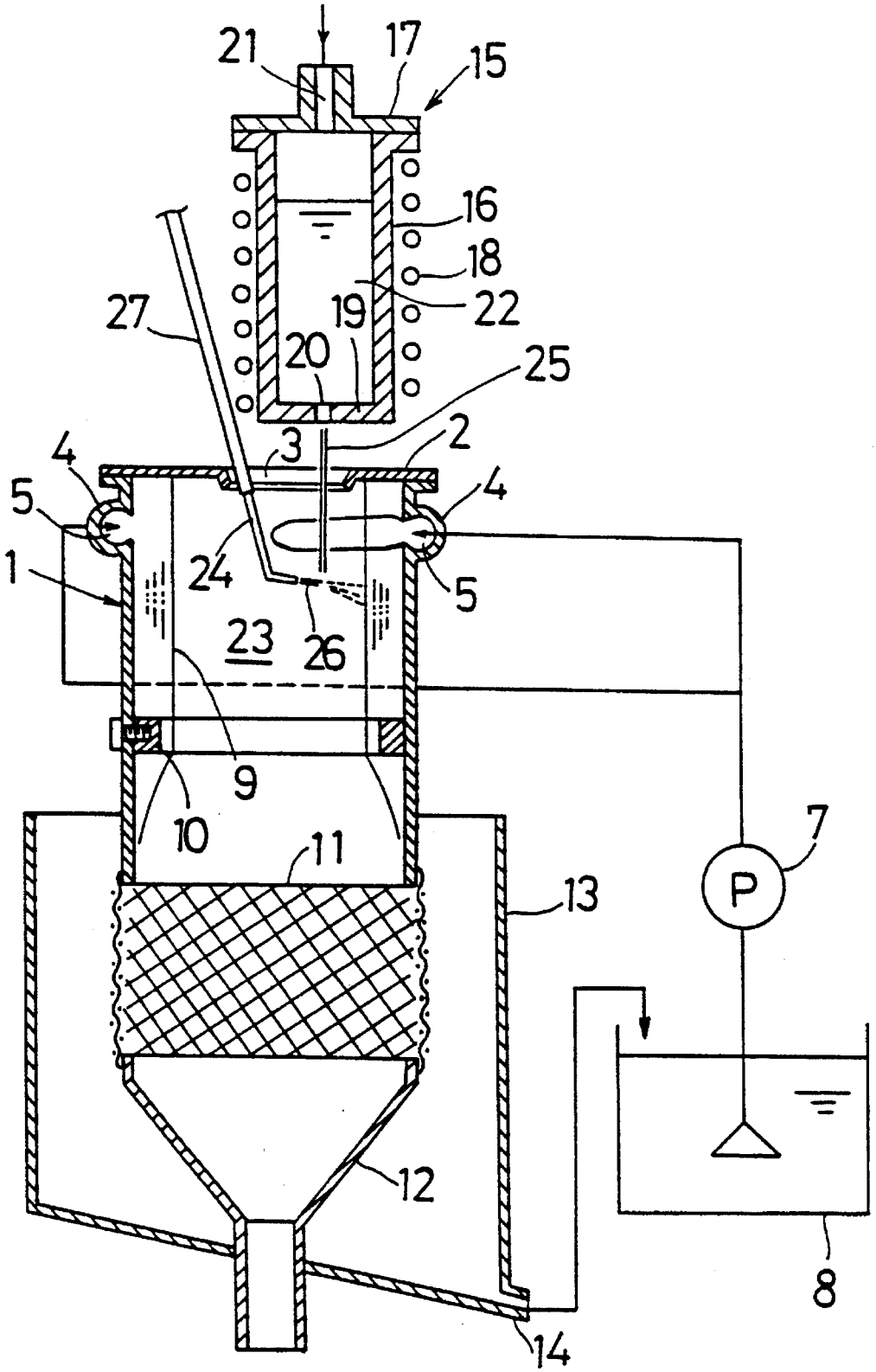
FIG. 1 is a fragmentary sectional view of a metal powder production apparatus embodying the invention.

FIG. 1 shows a metal powder production apparatus embodying the present invention. The apparatus comprises a cooling tubular body 1 having an inner peripheral surface for forming a cooling liquid layer 9 thereon, a crucible 15 serving as means for supplying a molten metal 25 in the form of a thin downward stream to a space 23 inside the cooling liquid layer 9, a pump 7 serving as means for supplying a cooling liquid to the tubular body 1, and a jet nozzle 24 serving as gas jet injection means for injecting a gas jet 26 for dividing the downward stream of molten metal 25 into molten droplets and supplying the droplets to the cooling liquid layer 9.

The tubular body 1 is hollow cylindrical, is installed with its axis positioned vertically and has an upper-end opening provided with an annular closure 2. The closure 2 is centrally formed with an opening 3 for supplying the molten metal to the interior of the cooling tubular body 1 therethrough. The cooling body 1 is formed at an upper portion thereof with a plurality of cooling liquid injection tubes 4 having a cooling liquid injection channel 5 and arranged at equal spacings circumferentially of the body. The channel 5 has an outlet (discharge outlet) which is so opened as to inject the cooling liquid into the tubular body 1 along the inner peripheral surface tangentially thereof. The center line of the opening portion of the channel 5 extends obliquely downward at an angle of about 0 to about 20° with respect to a plane orthogonal to the axis of the tubular body. The liquid injection tubes 4 are connected by piping to a tank 8 by way of a pump 7, which forces up the cooling liquid within the tank 8 and supplies the liquid to the inner peripheral surface of the tubular body 1 through the injection channels 5 of the injection tubes 4. Thus the cooling liquid layer 9 is formed on the inner peripheral surface of the tubular body 1. This layer flows down while swirling along the inner peripheral surface. The tank 8 is provided with an unillustrated a cooling liquid replenishing pipe. A cooler may be provided suitably within the tank 8 or at an intermediate portion of a channel for recycling the cooling liquid. Water is generally used as the cooling liquid since water is excellent in cooling ability and inexpensive. Alternatively, oil or like liquid for use in quenching hot metals may be used. When water is to be used, it is desired to remove dissolved oxygen from the water before use. Oxygen removing devices are readily available commercially.

A ring 10 for adjusting the thickness of the cooling liquid layer 9 is attached to an inner peripheral lower portion of the cooling tubular body 1 with bolts removably and replaceably. The thickness adjusting ring 10 limits the downward flow velocity of the cooling liquid, whereby the cooling liquid layer 9 can be readily formed with an approximately uniform inside diameter at a low flow rate. The tubular body 1 has a cooling liquid discharge end, i.e., a lower-end opening, which is provided with a hollow cylindrical draining net 11. A funnel-shaped powder collecting container 12 is attached to the lower end of the net 11. A cooling liquid collecting cover 13 is provided around and covers the net 11. The collecting cover 13 is provided in its bottom with a liquid outlet 14, which is connected to the tank 8 by piping.

The crucible 15 serving as the molten metal supply means and disposed above the cooling tubular body 1 is made of graphite, silicon nitride or like refractory and comprises a hollow cylindrical crucible body 16 having a bottom 19, and a clousre 17 for closing an opening at the upper end of the body 16. The crucible body 16 is provided with a heating induction coil 18 therearound and has a nozzle orifice 20 extending vertically through the bottom 19. The nozzle orifice 20 is opposed to the opening 3 of the annular closure 2. The closure 17 of the crucible 15 has a bore 21 for injecting a pressure medium such as Ar, $N_2$ or like inert gas and molten metal sent forward into the crucible therethrough. The molten metal 22 within the crucible 15 is forced through the nozzle orifice 20 and then through the opening 3 into the space 23 inside the cooling liquid layer 9 by the inert gas or the like injected into the crucible through the injection bore 21 under pressure.

Disposed in the space 23 inside the cooling liquid layer 9 is a jet nozzle 24 for jetting a compressed gas, such as air or inert gas, which is used in the usual gas atomization process. The nozzle 24 is attached to the forward end of a compressed gas supply pipe 27 inserted through the opening 3 of the annular closure 2 and has an orifice which is directed toward the thin stream of molten metal 25 forced out from the nozzle orifice 20 and toward the cooling liquid layer 9.

While the outlets of the cooling liquid injection channels 5 are formed in the side surface of an upper portion of the cooling tubular body 1 as illustrated, the distance of the outlets from the thickness adjusting ring 10, if large, results in the likelihood that the liquid layer 9 will have a reduced thickness at its midportion when the cooling liquid flows down at an increased velocity. It is therefore desirable that the outlets of the injection channels 5 be positioned between the upper face of the adjusting ring 10 and the midportion between the upper end of the tubular body 1 and the upper face of the ring 10. Even when the outlets are so positioned, the cooling liquid is centrifugally forced upward above the outlets, forming the same liquid layer of definite thickness as below the outlets.

The apparatus described operates in the following manner to produce a metal powder. First, the pump 7 is operated to form a cooling liquid layer 9 on the inner peripheral surface of the tubular body 1. Next, the molten metal 22 within the crucible 15 is forced out downward through the nozzle orifice 20, with a gas jetted from the jet nozzle 24 at a high speed as indicated at 26. The gas jet 26 from the jet nozzle 24 is applied to the molten metal 25 forced out from the crucible 15 in the form of a thin stream, dividing the molten metal 25 and sputtering the resulting molten droplets against the cooling liquid layer 9. The molten droplets thus sputtered are injected into the cooling liquid layer 9 which flows down while swirling and are rapidly cooled and solidified into metal particles. In this case, the shape of the particles can be altered from spherical to flat indefinite forms by suitably determining the distance from the location where the gas jet 26 collide with the molten metal 25 to the cooling liquid layer 9. For example, if the distance to the liquid layer 9 is small, the molten droplets divided by the gas jet 26 are injected into the liquid layer 9 before a soldified shell is formed over the surface, and are divided by the liquid layer 9 again to form fine particles of indefinite shape. Conversely, if the distance is sufficiently large, the solidified shell is formed over the surfaces of the molten droplets, permitting the droplets to remain substantially spherical when injected into the cooling liquid layer 9.

The metal powder in the cooling liquid layer 9 then flows down over the thickness adjusting ring 10 while swirling with the cooling liquid and enters the draining net 11 from the lower-end opening of the cooling tubular body 1. The cooling liquid in the net is centrifugally forced radially outward from the net 11, whereby the metal powder has its liquid content reduced by primary draining. The metal powder thus drained of the liquid enters the powder collecting container 12. The powder is discharged from the container, futher drained of the liquid by a centrifuge or like liquid removing device and dried by a dryer. The cooling liquid forced out from the net 11 is returned from the collecting cover 13 to the tank 8 and recylced for use.

Figure 2:
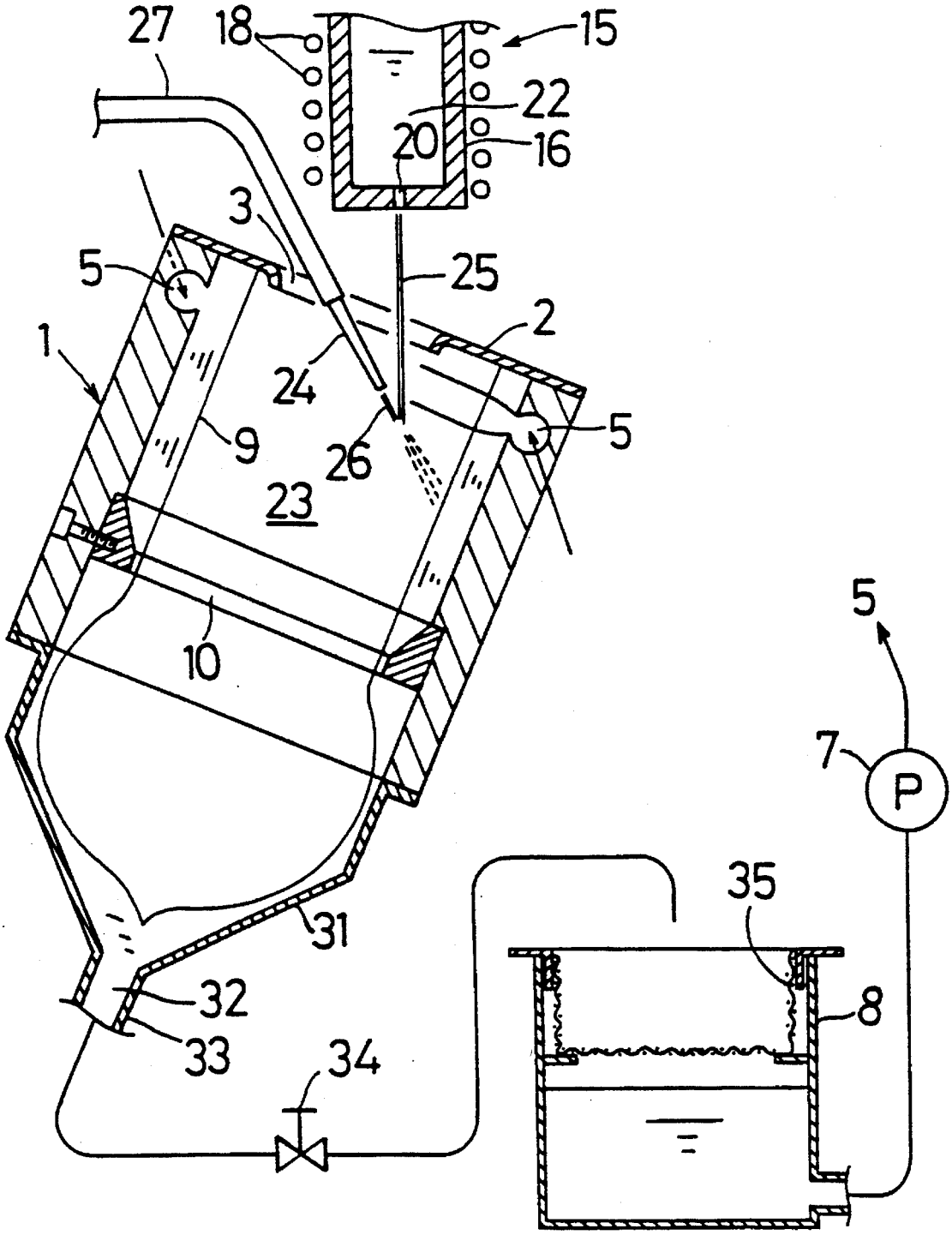
FIG. 2 is a fragmentary sectional view of another embodiment of apparatus.

FIG. 2 shows another metal powder production apparatus embodying the invention. Throughout FIGS. 1 and 2, like parts are designated by like reference numerals.

This embodiment has a cooling tubular body 1 which is installed with its axis inclined, and a cooling liquid injection channel 5 formed directly in the tubular body 1 which has a large wall thickness. The channel 5 has an inlet formed in the outer peripheral surface of the tubular body 1 and connected to a pump 7 by piping. The body 1 has a lower-end opening which is provided with a funnel-shaped closure 31 for closing the opening. The closure has a discharge pipe 33 attached to its bottom. The interior of the pipe serves as a discharge channel 32 for a cooling liquid. A thickness adjusting ring 10 having a tapered upper face is attached with bolts to the inner periphery of a lower portion of the tubular body 1. The discharge pipe 33 so extends that an outer-end opening (outlet) thereof is positioned above a tank 8, and is provided with a flow regulating valve 34 at an intermediate portion thereof. The tank 8 has an upper opening which is removably provided with a net basket 35.

With the present embodiment, the cooling liquid can be discharged with the discharge channel 32 filled with the liquid by suitably adjusting the opened position of the flow regulating valve 34. This makes it possible to prevent gas from flowing out through the discharge pipe 33 and to fill the space 23 inside the cooling liquid layer 9 with the gas of gas jet 26 from a jet nozzle 24. Accordingly, the oxidation of divided molten droplets can be prevented effectively by using an inert gas or like nonoxidizing gas.

Figure 3:
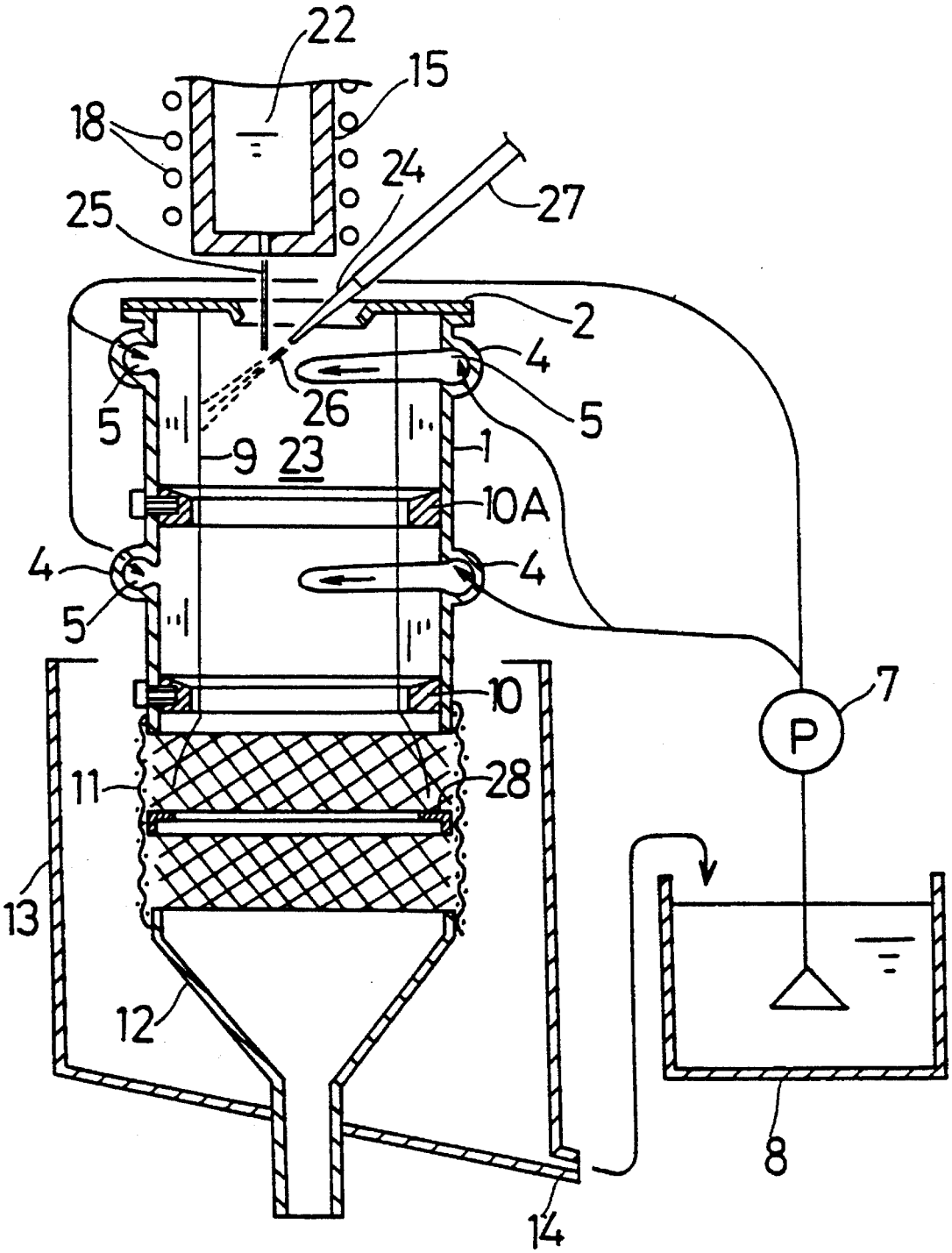
FIG. 3 is a fragmentary sectional view of a third embodiment of apparatus.

FIG. 3 shows a third embodiment of metal powder production apparatus, wherein a cooling tubular body 1 is formed in its inner peripheral surface with outlets of cooling liquid injection channels 5 as arranged in a plurality of (two) stages. The number of stages of injection channels 5 and the spacing therebetween with respect to the axial direction of the tubular body differ in accordance with the inside diameter of the tubular body, rate of discharge of the cooling liquid, pressure of injection, position of lower thickness adjusting ring 10, etc. A suitable number of stages may be provided as approximately equidistantly spaced apart so as to obtain a cooling liquid layer of substantially uniform inside diameter. The present embodiment has a plurality of stages of cooling liquid injection channels 5 above the thickness adjusting ring 10. This arrangement serves to prevent the liquid layer 9 above the ring 10 from decreasing in thickness owing to an increase in the downward flow velocity of the cooling liquid. The liquid layer 9 can therefore be formed easily with a substantially uniform inside diameter and a constant swirling velocity over an elongated region on the inner peripheral surface of the tubular body 1, hence an elongated cooling zone. As seen in the drawing, the thickness adjusting ring may be provided between the stages of injection channels 5 adjacent to each other axially of the tubular body as indicated at 10A, whereby the thickness and flow velocity of the layer 9 can be more stabilized. However, the cooling liquid injection channel 5 provided in a single stage in combination with a plurality of thickness adjusting rings is also effective for preventing the decrease in the thickness of the layer 9.

With the third embodiment of FIG. 3, a buffer flange 28 is removably attached to the inner periphery of the net 11 as by bolts. The flange 28 reduces the downward flow velocity of the cooling liquid to ensure drainage for a longer period of time for effective centrifugal removal of the liquid.

Figure 4:
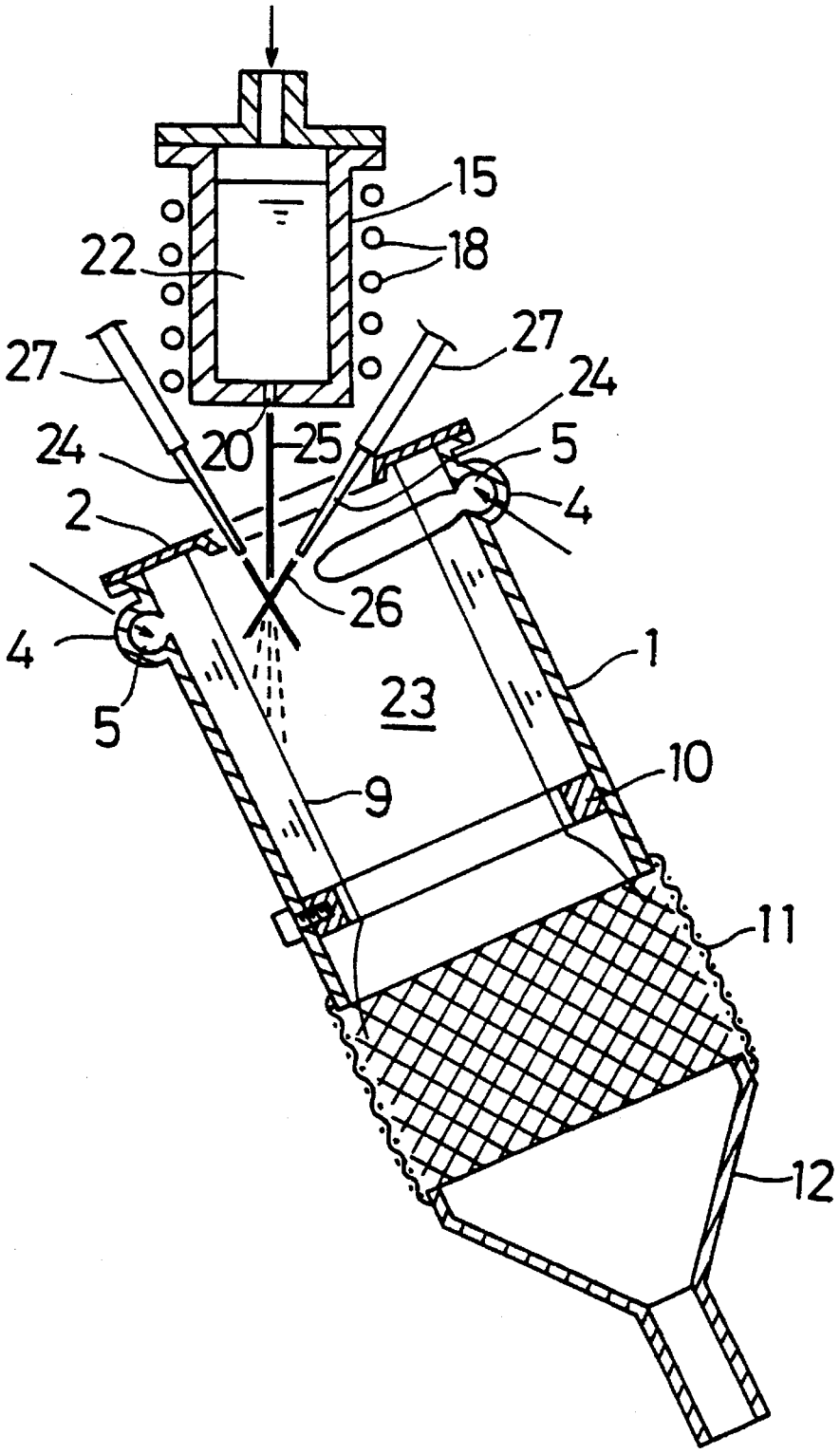
FIG. 4 is a fragmentary sectional view of a fourth embodiment of apparatus.

FIG. 4 shows a fourth embodiment of metal powder production apparatus, which has a cooling tubular body 1 installed with its axis inclined, and two jet nozzles 24, 24 attached to compressed gas supply pipes 27, 27 for producing gas jets 26 intersecting each other in a V-form in a space 23 inside a cooling liquid layer 9 on the inner peripheral surface of the body. Each of the jet nozzles 24, 24 has an orifice which is in the form of a slit, and the gas jet 26 is in the form of a film having a given width. The intersecting gas jets are V-shaped in section as illustrated in the drawing. A molten metal 25 flows out from a nozzle orifice 20 of a crucible 15 downward to the region where the V-shaped gas jets intersect, and is thereby divided. The V-shaped gas jets effectively divide the molten metal, forcing the divided molten droplets from the region of intersection into the inner periphery of the cooling liquid layer 9 over a specified area for the injection of the droplets even if the molten metal 25 flows down as somewhat deflected. Incidentally, a jet nozzle may be used which has a nozzle orifice in the form of an inverted conical slit for forming a gas jet defining an inverted conical face, such that the molten metal is supplied to the vertex of the jet. Alternatively, a plurality of jet nozzles each adapted to produce a linear gas jet may be arranged in an inverted conical form to provide an inverted conical assembly of linear gas jets for the molten metal to be supplied to the vertex of the assembly.

With the third and fourth embodiments, the cooling tubular body 1 is provided at its lower-end opening with a draining net 11, through which the gas forming the jet or jets 26 flows out. However, the lower-end opening may be provided with the closure 31 shown in FIG. 2 and having the discharge pipe 33. The space 23 inside the cooling liquid layer 9 can then be readily filled with the jet-forming gas by controlling the flow regulating valve 34 mounted on an intermediate portion of the discharge pipe 33.

With the foregoing embodiments, the cooling tubular body 1 is in the form of a hollow cylinder, but is not limited to this shape. The body may be so shaped as to have a rotationally symmetric inner peripheral surface the diameter of which gradually decreases toward the direction of movement of the cooling liquid. For example, the body may be in the form of a funnel. In the case where the body is trumpet-shaped with a paraboloid of revolution, a cooling liquid layer of uniform inside diameter can be formed even if no thickness adjusting ring is used. Further with the illustrated embodiments, the cooling tubular body is installed with its axis positioned vertically or obliquely, whereas this position is not limitative. The axis of the tubular body may be in any position insofar as cooling water can be injected into the body at a sufficient rate so as to form a cooling liquid layer 9 on the tubular body inner peripheral surface.

Further in the case of the illustrated embodiments, the thickness adjusting ring 10 has a horizontal or tapered upper face, which nevertheless is not limitative. For example, the ring may have a streamlined curved face extending from the outer peripheral edge of its upper end toward the inner peripheral edge of its lower end with a gradually decreasing diameter. Although the molten metal 22 in the crucible 15 is forced out through the nozzle orifice 20 under the pressure exerted by a pressure medium, the metal 22 may be forced out (caused to flow out) from the nozzle orifice 20 under gravity acting on itself without using the pressure medium.

The powders to be produced according to the invention are not limited to those of metals having a low melting point, such as aluminum and alloys thereof, but include those of metals having a high melting point, such as titanium, nickel, iron and alloys thereof. Thus the metals to be treated are not limited specifically.

Figure 5:
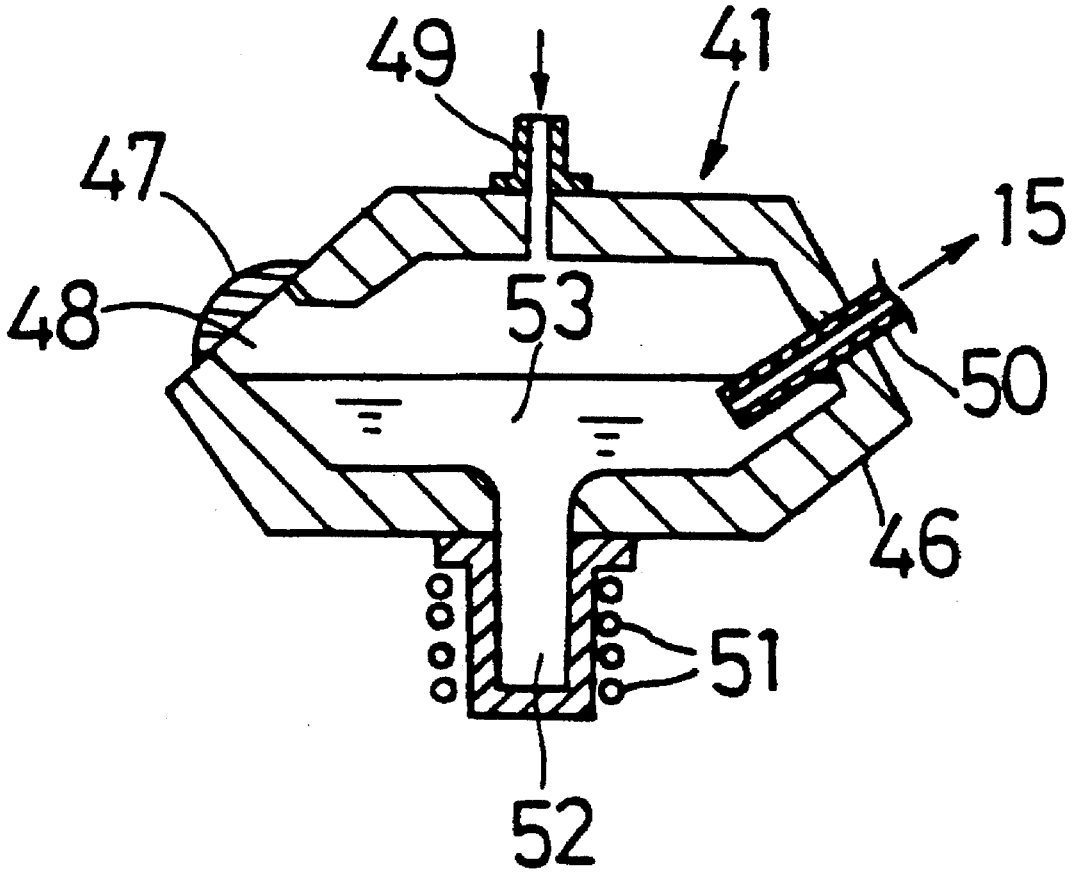
FIG. 5 is a sectional diagram illustrating a molten metal continuous feeder.
Figure 6:
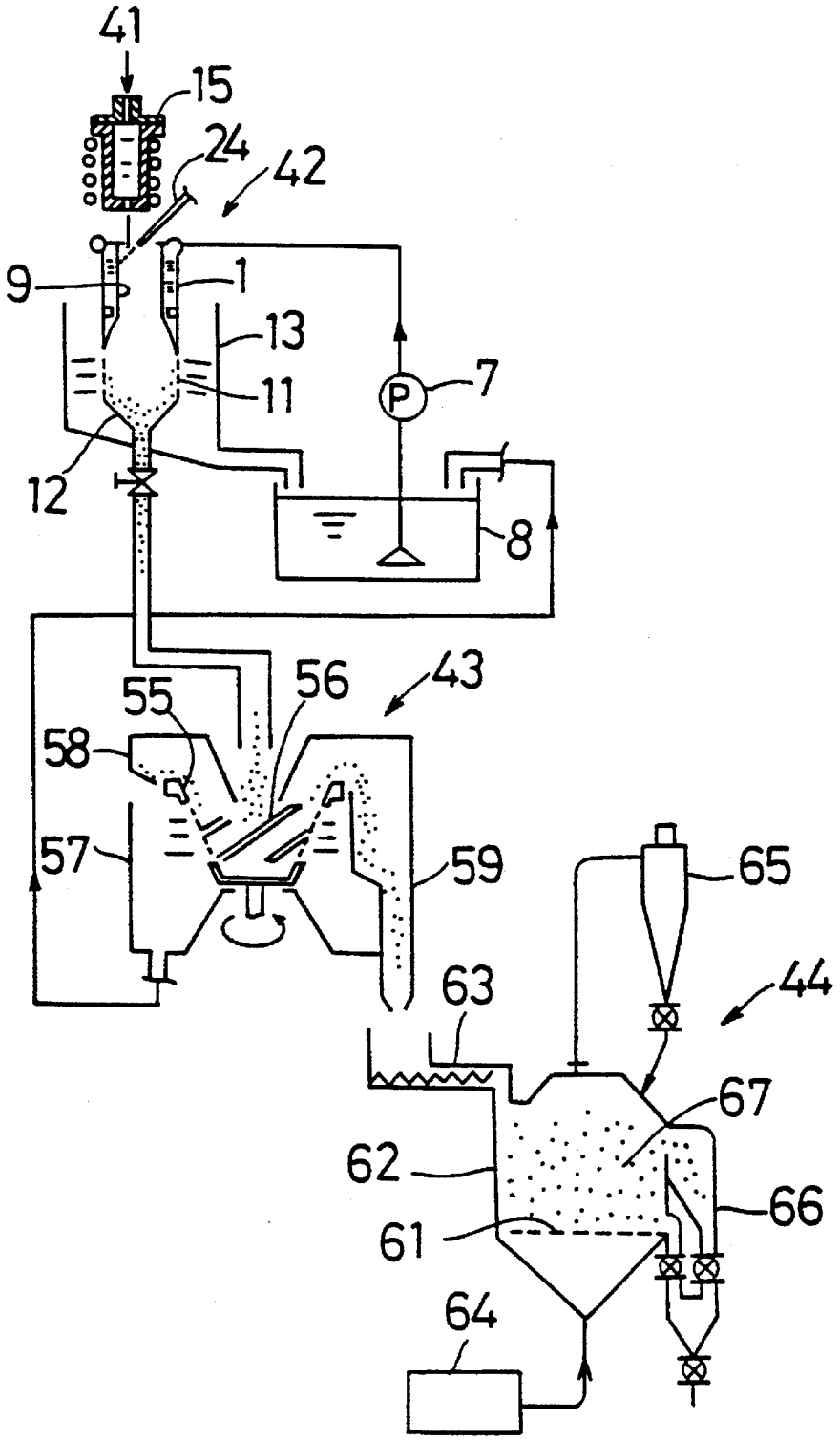
FIG. 6 is an overall layout of metal powder continuous production equipment.

FIGS. 5 and 6 show the overall construction of an example of metal powder continuous production equipment which includes the metal powder production apparatus already described with reference to FIG. 1 as the first embodiment and which is adapted to carry out a sequence of operations from the supply of molten metal through the production of metal powder, removal of the liquid and drying. With this equipment, the molten metal supplied from a molten metal continuous feeder 41 is treated by the metal powder production apparatus 42 already described, a continuous liquid removing device 43 and a continuous dryer 44 and made into a metal powder product. One of the other embodiments is of course usable as the metal powder production apparatus.

The molten metal continuous feeder 41 comprises a container 46 made of a heat-insulating refractory material. The container 46 has a molten metal inlet 48 closable with a closure 47, a pipe 49 for supplying an inert gas or like pressure medium, a discharge pipe 50 for molten metal 53 within the container, and a bottom cavity 52 provided with an induction heating coil 51. The molten metal 53 in the container 46 has its temperature controlled by the coil 51 and is fed to the crucible 15 of the apparatus 42 through the discharge pipe 50 under the pressure of the inert gas, such as argon gas, injected through the supply pipe 49. The discharge pipe 50 is heat-insulated by suitable means such as a heat-insulating layer or induction heater.

The metal powder produced by the apparatus 42 is fed to the continuous liquid removing device 43 by way of the powder collecting container 12 along with the cooling liquid remaining after the primary draining by the draining net 11, and is centrifugally acted on and thereby separated from the liquid. The continuous liquid removing device 43 comprises a rotary drum 55 flaring upward and having an intermediate peripheral wall which is formed by a screen plate with a multiplicity of small holes. The drum 55 has a multiplicity of projecting ribs 56 on its inner periphery for upwardly delivering the powder separated from the liquid. The rotary drum 55 is surrounded by a cooling liquid collecting cover 57, from the bottom of which the cooling liquid separated off is collected in the tank 8. Provided over the drum 55 is a metal powder collecting cover 58 having a discharge chute 59.

The wet metal powder delivered from the discharge chute 59 of the device 43 is subsequently fed to the continuous dryer 44. The dryer 44 comprises a drying container 62 having a porous membrane 61 with a multiplicity of pores, feed means 63 having a rotary feeder for supplying the wet material to an upper portion of the container 62, a hot air producing device 64 for supplying hot air from the bottom of the container 62, and a cyclone 65 for collecting fine particles from the air discharged from the top of the container 62. A discharge pipe 66 is attached to the side wall of the container 62 at its upper to lower portions.

A fluidized layer 67 is formed inside the drying container 62. The wet metal powder is vigorously mixed with the hot air within the layer 67 for heat exchange, rapidly dried and discharged usually in the form of an overflow from the container through the discharge pipe 66.

The molten metal continuous feeder, continuous liquid removing device and continuous dryer for use in practicing the present invention are not limited to those described above, but suitable devices commercially available are usable.

Metal powder preparation examples will be described below in detail.

Preparation Example 1

Figure 7:
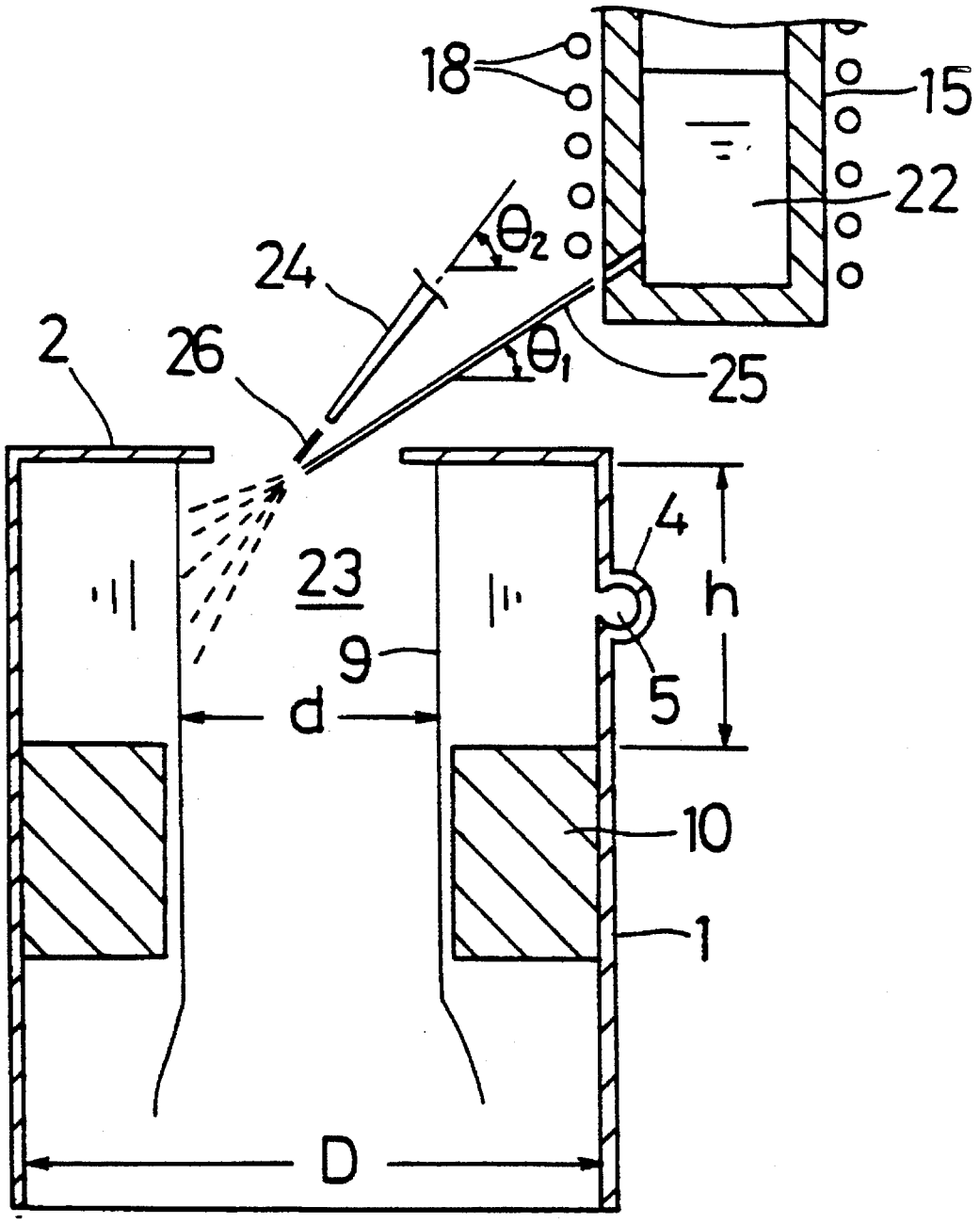
FIG. 7 is a fragmentary sectional view of a metal powder production apparatus used in a preparation example of the invention.

The production apparatus shown in FIG. 7 was used for preparing an aluminum alloy powder. The cooling tubular body 1 shown was 100 mm in inside diameter D. The cooling liquid injection channel 5 had outlets positioned at the midpoint between the upper end of the body 1 and the upper end of the thickness adjusting ring 10. Cooling water was injected into the body at a flow rate of 0.3 $m^3$/min from the channel outlets which were 11.5 mm in diameter. Consequently formed above the ring 10 was a cooling liquid layer 9 which was 55 mm in inside diameter d, 50 mm in length h and 43 m/sec in flow velocity at the surface of the water layer.

A molten aluminum alloy (composition: Al-12 Si-1 Mg-1 Cu, in wt. %) was prepared in the crucible 15 at 1000° C. The molten metal 22 in the crucible 15 was pressurized by supplying argon gas thereto at 1.0 kgf/$cm^2$, and a thin stream of molten metal 25, 2 mm in diameter, was injected from the nozzle orifice 20 of the crucible 15 into a space 23 inside the liquid layer 9. The stream of molten metal 25 made an injection angle $\theta_1$ of 30 deg with a horizontal plane.

Figure 8:
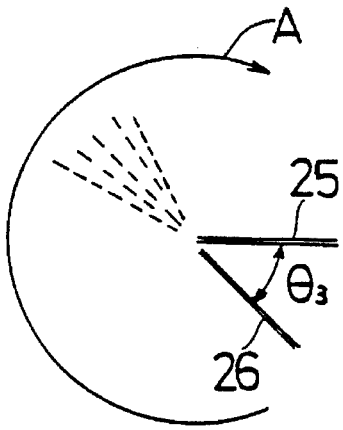
FIG. 8 is a diagram showing the relation in position between a thin stream of molten metal and a gas jet used in the preparation example and as seen from above.

An air jet 26 was forced out at 5 kgf/$cm^2$ from the jet nozzle 24 with a nozzle orifice diameter of 6 mm against the molten metal 25 in the space 23, at an angle $\theta_2$ of 45 deg between the jet 26 and a horizontal plane. When seen from above as shown in FIG. 8, the angle $\theta_3$ made by the jet 26 with the thin stream of molten metal 25 was 45 deg as measured from the molten metal 25 in the swirling direction A of the cooling liquid layer.

Figure 9:
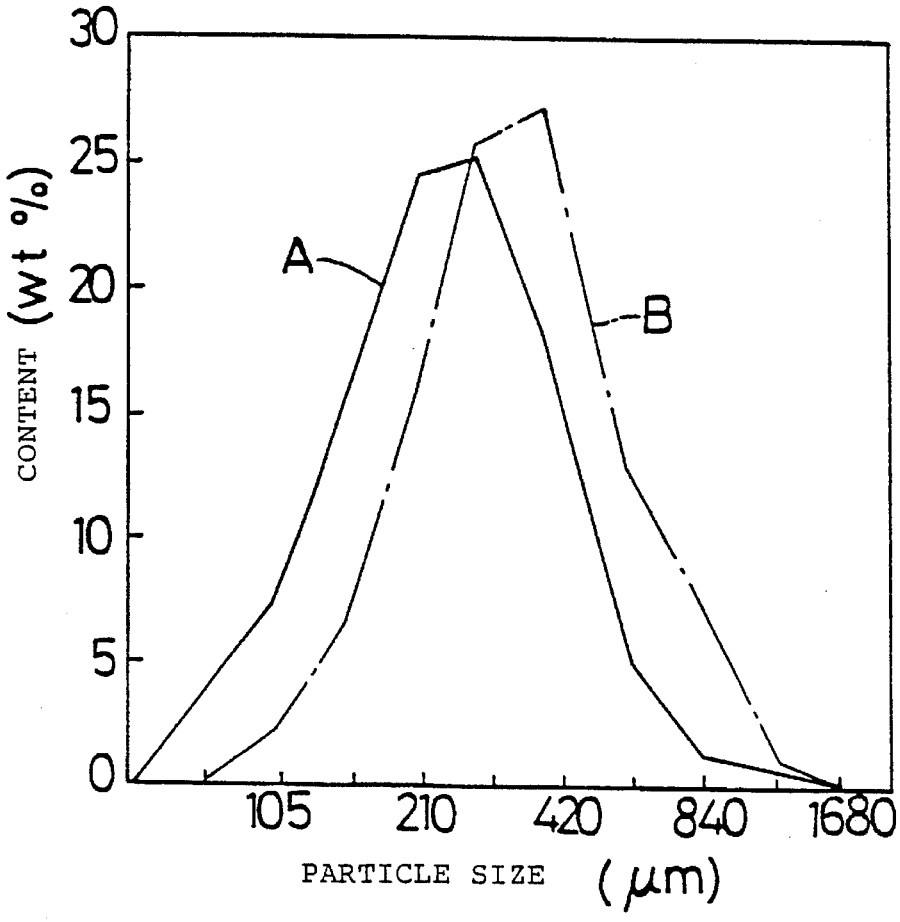
FIG. 9 is a graph showing the particle size distribution of metal powders prepared in the example and a comparative preparation example.

The aluminum alloy powder consequently obtained had a particle size distribution (relation between the particle size of particular particles in the powder and the content in wt. % of the particles of the size based on the whole amount of the powder) indicated at A in FIG. 9. The powder was 291.8 micrometers in mean particle size and 0.90 g/$cm^3$ in bulk density. The particles were found to be flat and indefinite in shape. This appears to indicate that the molten droplets divided by the air jet were divided again by the cooling liquid layer.

For comparison, an aluminum alloy powder was prepared under the same conditions as above except that no air jet was applied to the molten metal. The result achieved is shown also in FIG. 9 as indicated at B. The powder was 420 micrometers in mean particle size and 0.70 g/$cm^3$ in bulk density. This reveals that the application of the air jet according to the invention readily produces finer particles.

Preparation Example 2

An aluminum alloy powder having the same composition as in Preparation Example 1 was prepared using the apparatus shown in FIG. 2. The cooling tubular body 1 was 200 mm in inside diameter, and the axis of the body was inclined at an angle of 25 deg with respect to a vertical. The cooling liquid injection channel 5 had outlets which were 11.5 mm in diameter and through which cooling water was injected into the body at a flow rate of 0.3 $m^3$/min. As a result, a cooling liquid layer 9, 250 mm in inside diameter, 300 mm in length and 20 m/sec in average flow velocity, was formed between the annular closure 2 and the thickness adjusting ring 10. The flow regulating valve 34 was adjusted to fill the discharge channel 32 with the cooling liquid.

A molten aluminum alloy was prepared at 1000° C. in the crucible 15, and the molten metal 22 within the crucible was forced out in the form of a thin stream of molten metal 25, 2 mm in diameter, from the nozzle orifice 20 of the crucible 15 vertically downward into a space 23 inside the liquid layer 9 by supplying argon gas to the crucible 15 at 1.0 kgf/$cm^2$.

An argon gas jet 26 was applied at 10 kgf/$cm^2$ from the jet nozzle 24 with a nozzle orifice diameter of 6 mm to the molten metal 25 in the space 23, whereby the molten metal 25 was made into particles. The angle made by the argon gas jet 26 with the molten metal 25 was 30 deg.

Figure 10:
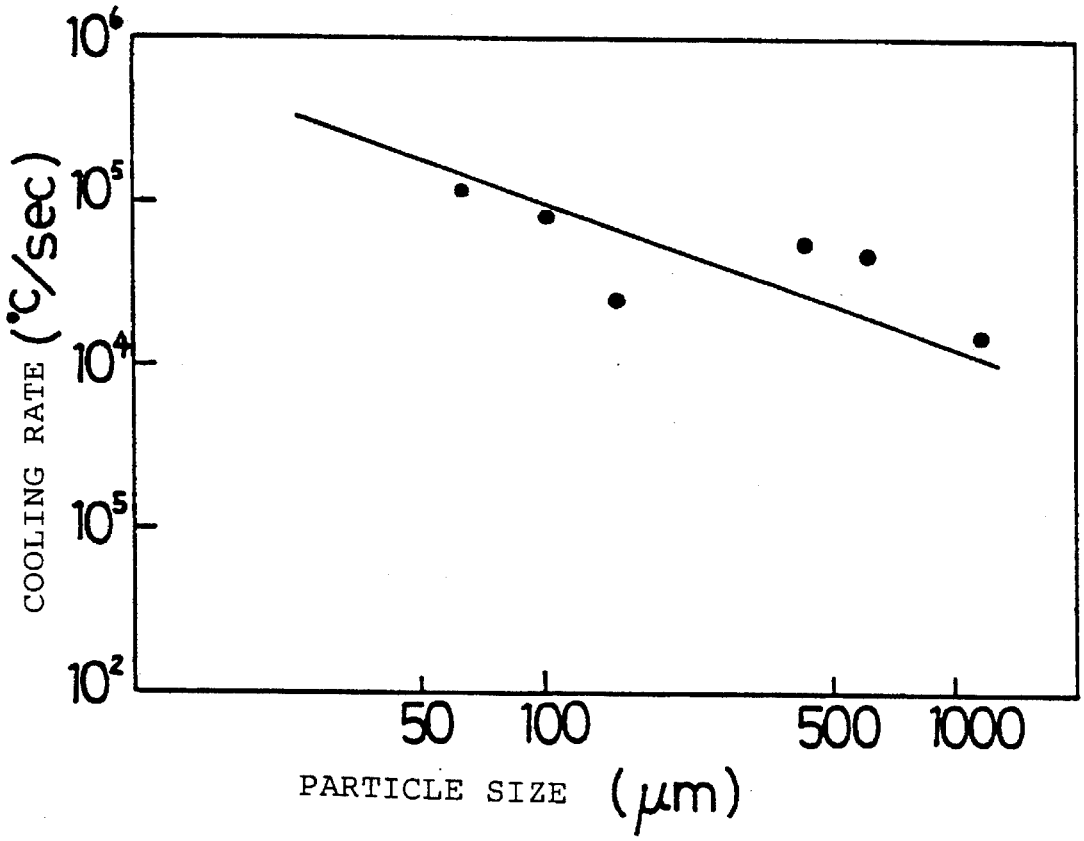
FIG. 10 is a graph showing the relation between the cooling rate and the particle size of metal powder prepared in another preparation example of the invention.

The powder obtained was 200 micrometers in mean particle size and 1.3 g/$cm^3$ in bulk density. FIG. 10 shows the relation between the particle size and the cooling rate. The cooling rate was determined from the metal structure of particles of the powder. The drawing shows that in the case of the metal powder prepared according to the invention, the cooling rate is $10^4$ to $10^5$°C./sec even when relatively large particles, 100 to 1000 micrometers in size, are formed. This indicates that the invention affords a microfine structure. The drawing appears to indicate that the cooling rate for giving particles of 0.1 micrometer in size is at least $10^8$°C./sec.

Next, the powder was checked for gas contents, which were found to be 12 ppm of $H_2$ and 500 ppm of $O_2$. For comparison, an aluminum alloy powder was prepared under the same conditions as above except that the flow regulating valve 34 was fully opened so as not to close the discharge pipe 33 with the cooling water. The resulting powder was found to contain 20 ppm of $H_2$ and 820 ppm of $O_2$. This indicates that the product of the invention is much lower in gas contents than the comparative example.

Preparation Example 3

An iron alloy powder was prepared under the same conditions as in Preparation Example 2. The iron alloy had the composition of Fe-1.3 C-4 Cr-3.5 Mo-10 W-3.5 V-10 Co as expressed in wt. %, and was melted at 1600° C.

The powder obtained was 250 micrometers in mean particle size. When checked for gas contents, the powder was found to contain 9 ppm of $H_2$, 580 ppm of $O_2$ and 720 ppm of $N_2$. When an iron alloy powder of the same composition as above was prepared under the same conditions as above except that the average flow velocity of the cooling liquid layer was 5 m/sec, the powder was found to contain 15 ppm of $H_2$, 1200 ppm of $O_2$ and 740 ppm of $N_2$. This reveals that as the flow velocity of the cooling liquid layer is increased, the molten droplets can be more rapidly separated or released from the vapor of the cooling liquid produced therearound so as to be free from contaminants more effectively.

INDUSTRIAL APPLICABILITY

The present invention is useful for the production of metal powders for use as powdery materials for powder metallurgy, hot isostatic pressing, hot forging, hot extrusion, etc., as compounding powders for synthetic resins, rubbers, metals, etc. and as magnetic powders for electromagnetic clutches or brakes.

We claim:

1. A method of producing a metal powder, comprising the steps of:

providing a nonrotating fixed cooling tubular body having an upper end and a lower end through which cooling liquid is discharged;

injecting a cooling liquid generally tangentially into the nonrotating fixed cooling tubular body along an inner peripheral surface thereof with a velocity to form a cooling liquid layer moving toward a cooling liquid discharge end of the tubular body while swirling along the tubular body inner peripheral surface and leaving a liquid free central space within the tubular body;

decreasing downward flow velocity of the injected cooling liquid by providing said cooling tubular body with a narrower width at a lower portion of the tubular body than at an upper portion of the tubular body, said narrower width being provided by (a) providing a ring for adjusting the thickness of the cooling liquid layer extending around the inner peripheral surface of the cooling tubular body, (b) providing the ring with an inwardly extending upper surface extending inwardly from the inner peripheral surface such that the cooling liquid is forced to flow over the ring inwardly away from the inner peripheral surface, and (c) providing the ring at a location within said cooling tubular body such that the upper surface of the ring is in between the upper end and the lower end such that the cooling liquid is forced to flow over the ring prior to being discharged from the lower end;

supplying a molten metal to a space inside the cooling liquid layer;

applying a gas jet to the molted metal to divide the molten metal and supply the divided molten metal to the cooling liquid layer; and discharging the cooling liquid containing a metal powder solidified in the liquid layer from the cooling liquid discharge end of the tubular body to outside.

2. A method of producing a metal powder as defined in claim 1, wherein the step of discharging includes the cooling liquid containing the metal powder solidified in the liquid layer being discharged to outside of the tubular body through a discharge pipe attached to a closure provided at the discharge end of the tubular body while filling the pipe with the cooling liquid.

3. A method of producing a metal powder as defined in claim 1 or 2 wherein water is used as the cooling liquid, and the gas jet is formed by an inert gas.

4. A method of producing a metal powder as defined in claim 1 or 2 wherein the cooling tubular body is in the form of a hollow cylinder.

5. A method of producing a metal powder as defined in claim 1 or 2 wherein the molten metal is supplied by gravity.

6. A method of producing a metal powder as defined in claim 1 or 2 wherein the metal powder discharged along with the cooling liquid is continuously drained of the liquid and subsequently dried continuously.

7. A method of producing a metal powder as defined in claim 2, wherein gas applied from the gas jet is maintained within the space inside the cooling liquid layer by the liquid in the discharge pipe.

8. The method of producing a metal powder as defined in claim 1, wherein the step of discharging the cooling liquid includes draining the liquid through a circumferential drainage net around the periphery of the tubular body, the liquid draining therethrough by centrifugal force of the liquid.

9. A method of producing a metal powder as defined in claim 1, wherein said ring is attached in the inner peripheral surface of the cooling tubular body.

10. A method of producing a metal powder as defined in claim 9, wherein said ring has a tapered upper surface.

11. An apparatus for producing a metal powder, comprising:

a nonrotating fixed cooling tubular body, said cooling tubular body having an upper end and a lower end through which cooling liquid is discharged;

a cooling liquid injection channel means for injecting a cooling liquid generally tangentially into the tubular body and creating a cooling liquid layer along an inner peripheral surface thereof;

said cooling tubular body having a narrower width at a lower portion of the tubular body than at a level at which said cooling liquid injection channel means injects said cooling liquid;

molten metal supply means for supplying a molten metal into a space inside the cooling liquid layer formed by the cooling liquid injected from the injection channel;

gas jet injection means for producing a gas jet to divide the molten metal and supply the divided molten metal to the cooling liquid layer;

cooling liquid supply means for supplying the cooling liquid to the cooling liquid injection channel;

wherein said narrower width includes a ring for adjusting the thickness of the cooling liquid layer extending around the inner peripheral surface of the cooling tubular body, said ring having an inwardly extending upper surface extending inwardly from said inner peripheral surface such that the cooling liquid is forced to flow over said ring inwardly away from said inner peripheral surface; and said ring being located within said cooling tubular body such that said upper surface of said ring is in between said upper end and said lower end such that the cooling liquid is forced to flow over said ring prior to being discharged from said lower end.

12. An apparatus for producing a metal powder as defined in claim 11, wherein the tubular body has a closure attached to its cooling liquid discharge end, wherein a discharge pipe is attached to the closure for discharging the cooling liquid therethrough, and wherein a flow regulation means is provided for keeping the pipe filled with the cooling liquid.

13. An apparatus for producing a metal powder as defined in claim 11 or 12 wherein the cooling tubular body is in the form of a hollow cylinder.

14. An apparatus for producing a metal powder as defined in claim 13, wherein said narrower width includes said ring attached to the inner peripheral surface of the cooling tubular body.

15. An apparatus for producing a metal powder as defined in claim 14 including a plurality of rings for adjusting the thickness of the layer.

16. An apparatus for producing a metal powder as defined in claim 14, wherein said ring has a tapered upper surface.

* * * * *